United States Patent [19]

Kanno

[11] Patent Number: 4,553,850

[45] Date of Patent: Nov. 19, 1985

[54] LOGICAL REGULATION CIRCUIT FOR AN ELECTRONIC TIMEPIECE

[75] Inventor: Yosuke Kanno, Tokyo, Japan

[73] Assignee: Kabushiki Kaisha Daini Seikosha, Tokyo, Japan

[21] Appl. No.: 475,447

[22] Filed: Mar. 15, 1983

[30] Foreign Application Priority Data

Mar. 16, 1982 [JP] Japan ..... 57-41161

[51] Int. Cl.[4] ..... G04B 17/12

[52] U.S. Cl. ..... 368/201; 361/200

[58] Field of Search ..... 368/200, 201, 202

[56] References Cited

U.S. PATENT DOCUMENTS 4,282,594 8/1981 Ichikawa ..... 368/201

*Primary Examiner*—Bernard Roskoski

*Attorney, Agent, or Firm*—Robert E. Burns; Emmanuel J. Lobato; Bruce L. Adams

[57] ABSTRACT

A logic regulation circuit for regulating the frequency dividing ratio of a variable frequency divider of an electronic timepiece comprises a first switch group having a plurality of ON and OFF switching states representative of different frequency rates and a second switch group having a plurality of ON and OFF switching states representative of frequency rate adjustment values. A first set of memory circuits is connected to the first switch group for memorizing the ON-OFF information thereof, and a second set of memory circuits is connected to the second switch group for memorizing the ON-OFF information thereof. A calculation circuit is connected to the first and second sets of memory cirucits for receiving the information content thereof and for adjusting the frequency rates represented by the information content of the first memory circuits in accordance with the frequency rate adjustment values represented by the information content of the second memory circuits to produce corresponding frequency rate signals suitable for regulating the frequency dividing ratio of the variable frequency divider. The calculation circuit includes a control signal generator for producing control signals according to the frequency rate adjustment values set by the second switch group, and logic circuitry for increasing or decreasing the frequency rates set by the first switch group in response to the control signals.

15 Claims, 9 Drawing Figures

FIG. 3
(PRIOR ART)

| SW 1 | SW 2 | SW 3 | SW 4 | rate (sec/day) |
|---|---|---|---|---|
| 1 | 1 | 1 | 1 | 0.0 |
| 1 | 1 | 1 | 0 | −0.527 |
| 1 | 1 | 0 | 1 | −0.791 |
| 1 | 1 | 0 | 0 | −1.055 |
| 1 | 0 | 1 | 1 | −1.318 |
| 1 | 0 | 1 | 0 | −1.582 |
| 1 | 0 | 0 | 1 | −1.846 |
| 0 | 0 | 0 | 0 | −2.109 |
| 0 | 1 | 1 | 1 | −2.373 |
| 0 | 1 | 1 | 0 | −2.637 |
| 0 | 1 | 0 | 1 | −2.900 |
| 0 | 1 | 0 | 0 | −3.164 |
| 0 | 0 | 1 | 1 | −3.428 |
| 0 | 0 | 1 | 0 | −3.691 |
| 0 | 0 | 0 | 1 | −3.955 |
| 0 | 0 | 0 | 0 | −4.219 |

FIG. 6

| 13a | 13b | 14a | 14b |
|---|---|---|---|
| 0 | 0 | 0 | 0 |
| 0 | 1 | 0 | 1 |
| 1 | 0 | 1 | 1 |
| 1 | 1 | 1 | 0 |

FIG. 7

(13a=0, 13b=1)

| 12a | 12b | 12c | 12d | 15a | 15b | 15c | 15d |
|---|---|---|---|---|---|---|---|
| 0 | 0 | 0 | 0 | 0 | 0 | 0 | 1 |
| 0 | 0 | 0 | 1 | 0 | 0 | 1 | 0 |
| 0 | 0 | 1 | 0 | 0 | 0 | 1 | 1 |
| 0 | 0 | 1 | 1 | 0 | 1 | 0 | 0 |
| 0 | 1 | 0 | 0 | 0 | 1 | 0 | 1 |
| 0 | 1 | 0 | 1 | 0 | 1 | 1 | 0 |
| 0 | 1 | 1 | 0 | 0 | 1 | 1 | 1 |
| 0 | 1 | 1 | 1 | 1 | 0 | 0 | 0 |
| 1 | 0 | 0 | 0 | 1 | 0 | 0 | 1 |
| 1 | 0 | 0 | 1 | 1 | 0 | 1 | 0 |
| 1 | 0 | 1 | 0 | 1 | 0 | 1 | 1 |
| 1 | 0 | 1 | 1 | 1 | 1 | 0 | 0 |
| 1 | 1 | 0 | 0 | 1 | 1 | 0 | 1 |
| 1 | 1 | 0 | 1 | 1 | 1 | 1 | 0 |
| 1 | 1 | 1 | 0 | 1 | 1 | 1 | 1 |
| 1 | 1 | 1 | 1 | 0 | 0 | 0 | 0 |

FIG. 8

(13a=1, 13b=0)

| 12a | 12b | 12c | 12d | 15a | 15b | 15c | 15d |
|---|---|---|---|---|---|---|---|
| 0 | 0 | 0 | 0 | 1 | 1 | 1 | 1 |
| 0 | 0 | 0 | 1 | 0 | 0 | 0 | 0 |
| 0 | 0 | 1 | 0 | 0 | 0 | 0 | 1 |
| 0 | 0 | 1 | 1 | 0 | 0 | 1 | 0 |
| 0 | 1 | 0 | 0 | 0 | 0 | 1 | 1 |
| 0 | 1 | 0 | 1 | 0 | 1 | 0 | 0 |
| 0 | 1 | 1 | 0 | 0 | 1 | 0 | 1 |
| 0 | 1 | 1 | 1 | 0 | 1 | 1 | 0 |
| 1 | 0 | 0 | 0 | 0 | 1 | 1 | 1 |
| 1 | 0 | 0 | 1 | 1 | 0 | 0 | 0 |
| 1 | 0 | 1 | 0 | 1 | 0 | 0 | 1 |
| 1 | 0 | 1 | 1 | 1 | 0 | 1 | 0 |
| 1 | 1 | 0 | 0 | 1 | 0 | 1 | 1 |
| 1 | 1 | 0 | 1 | 1 | 1 | 0 | 0 |
| 1 | 1 | 1 | 0 | 1 | 1 | 0 | 1 |
| 1 | 1 | 1 | 1 | 1 | 1 | 1 | 0 |

LOGICAL REGULATION CIRCUIT FOR AN ELECTRONIC TIMEPIECE

BACKGROUND OF THE INVENTION

The present invention relates to a logical regulation circuit for an electronic timepiece for regulating the frequency rate of a high frequency time standard by ON-OFF information of external switches, and more particularly to a logical regulation circuit for an electronic timepiece capable of repeatedly regulating the predetermined frequency rate.

Conventionally, an output from an oscillator has been logically regulated by being divided at a suitable frequency dividing ratio with a variable frequency divider, by way of a method for regulating the rate.

FIG. 1 shows an embodiment of a conventional logical regulation circuit. Numeral 1 is an oscillator, 2 is a variable frequency divider, 3*a*–3*d* are switch members SWs 1–4, 4*a*–4*d* are n-channel MOS transistors (referred to as n-Trs hereafter), 5*a*–5*d* are half-latches, 6 is a clock signal CL1 for turning on the n-Trs 4*a*–4*d*, and 7 is a clock signal CL2 for the half-latches 5*a*–5*d*. The relationship between the CL1 and CL2 signals is shown in a timing chart of FIG. 2 from which it can be seen that the half-latches 5*a*–5*d* read and memorize 1 or 0 by the ON or OFF operation of the SWs 1–4 of 3*a*–3*d*. The variable frequency divider 2 divides the high frequency output signal from the oscillator 1 at the frequency dividing ratio set by the memory information of the half-latches 5*a*–5*d* to provide a unit time signal, and regulates at the selected rate value, e.g., as shown in FIG. 3. The frequency rate values in FIG. 3 are set on the assumption that the rate is 0 when the output frequency of the oscillator 1 is not logically regulated. The symbols 1, 0 of the SWs 1–4 in FIG. 3 respectively indicate that the switches 3*a*–3*d* are ON or OFF in FIG. 1. (A detailed description of the variable frequency divider 2 is omitted since it is a prior art device of known construction). The conventional logical regulation circuit, however, has the following drawbacks:

(1) When the SWs 1–4 are constructed by cutting off or not cutting off the wiring on the circuit board, the rate cannot be regulated again once it is set. This is disadvantageous on the assembly process or for service after sale.

(2) When the SWs 1–4 are constructed by mechanical traveling contacts, regulation of the rate is possible. To obtain 16 combinations of SWs 1–4 as shown in FIG. 3, however, the construction becomes extremely complicated, which results in high cost.

(3) When the SWs 1 and 2 are constructed by turning off or not the wiring on the circuit board and the SWs 3 and 4 are constructed by mechanical traveling contacts, for instance, the construction of the mechanical traveling contacts is simplified. However, the regulation of the rate becomes unidirectional by some ON-OFF combination of the SWs 1–4.

SUMMARY OF THE INVENTION

Accordingly, it is an object of the present invention to provide a logical regulation circuit capable of repeatedly regulating any predetermined frequency rates both in the plus and minus directions by an extremely simple circuitry construction at a low cost.

BRIEF DESCRIPTION OF THE DRAWINGS

FIG. 3 shows the relationship between the SWs 1–4 in FIG. 1 and the pre-set rates.

DESCRIPTION OF THE PREFERRED EMBODIMENTS

Figure 1:
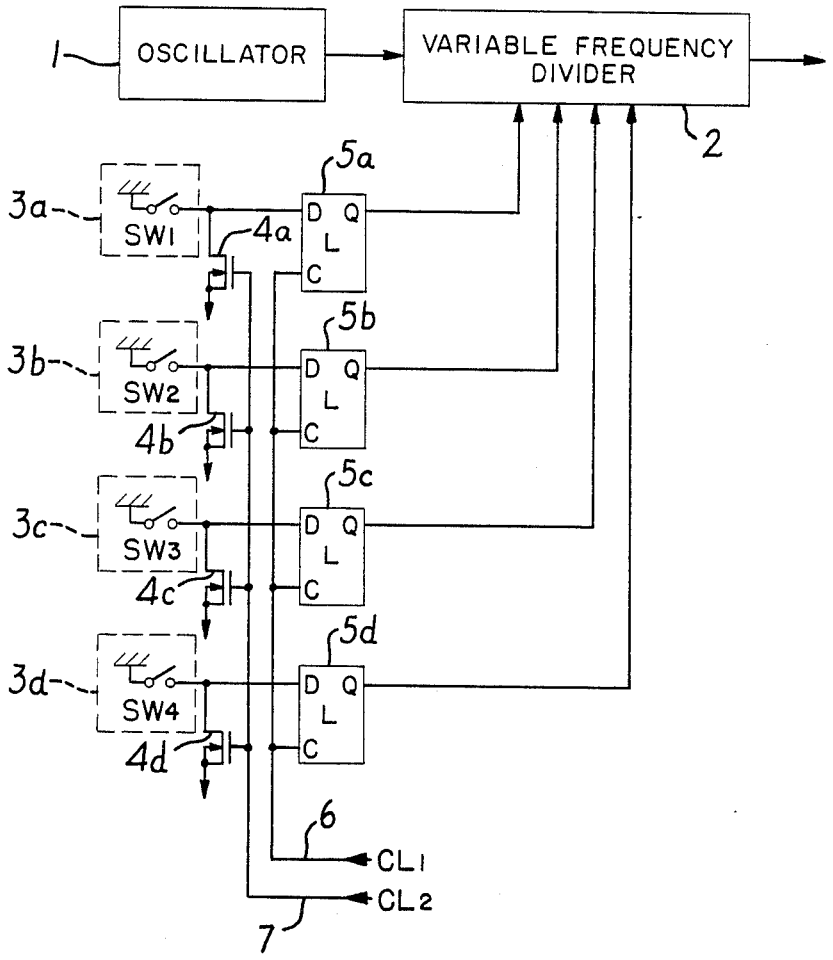
FIG. 1 (PRIOR ART)
FIG. 1 is a circuitry block diagram showing a conventional embodiment.
Figure 2:
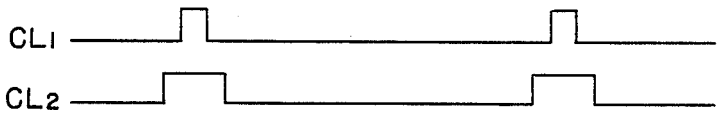
FIG. 2 (PRIOR ART)
FIG. 2 is a timing chart showing a part of the signals used in FIG. 1.
Figure 4:
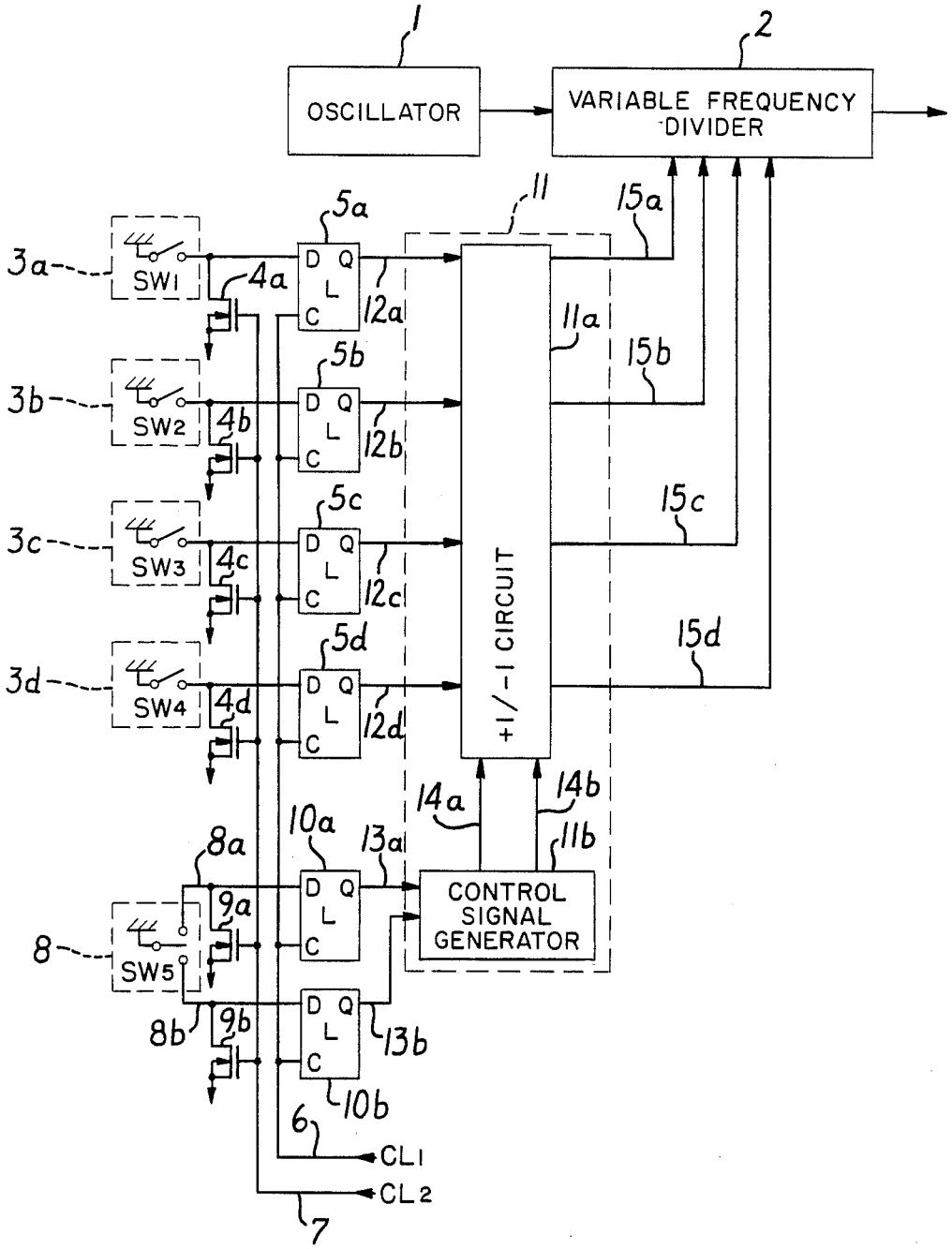
FIGS. 4 and 9 are circuitry block diagrams showing the embodiments of the present invention.

FIG. 4 is a circuitry block diagram showing an embodiment of the present invention. 3*a*–3*d* are a first switch group (SWs 1–4) for setting different frequency rates, 5*a*–5*d* are first memory circuits, 8 is a second switch group (SW5) for setting different frequency rate adjustment values, 10*a* and 10*b* are second memory circuits, and 11 is a calculation circuit consisting of a $+1/-1$ circuit 11*a* and a control signal generator 11*b*. The switch 8 has three states namely: both terminals 8*a* and 8*b* are OFF; only the terminal 8*a* is ON; or only the terminal 8*b* is ON. The value of the frequency rate is determined by n-Trs 9*a* and 9*b* when the terminal 8*a* and/or 8*b* is OFF. Each state of the switch 8 (0,0), (1,0), (0,1) is read and memorized in the second memory circuits (half-latches) 10*a* and 10*b* by a clock input signal 6.

Figure 5:
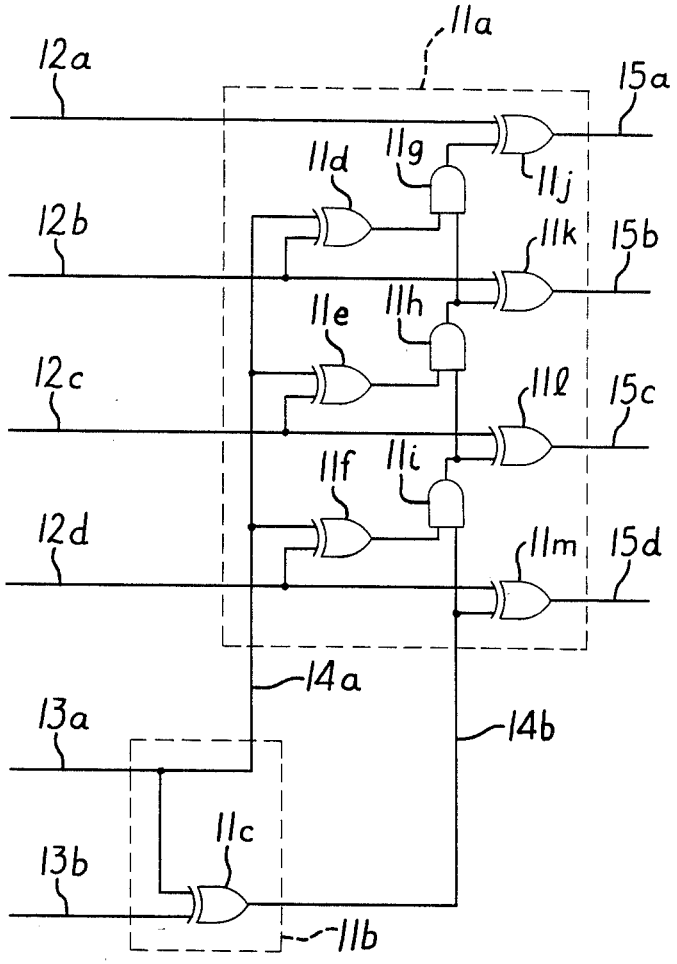
FIG. 5 is a circuit diagram embodying a part of the circuit block in FIG. 4, and FIGS. 6–8 show the relationship between the signals in FIG. 5.

FIG. 5 is a circuit diagram embodying the calculation circuit 11 in FIG. 4. In FIG. 5, the control signal generator 11*b* generates an output control signal 14*a* which is equivalent to a Q output signal 13*a* of the half-latch 10*a*, and an output control signal 14*b* from an exclusive OR gate 11*c* (referred to as EX-OR hereafter) which receives Q output signals 13*a* and 13*b* of the half-latches 10*a* and 10*b*.

FIG. 6 shows the relationship between the inputs 13*a*, 13*b* and the outputs 14*a*, 14*b* of the control signal generator 11*b*. The $+1/-1$ circuit 11*a* produces Q output signals 12*a*–12*d* from the half-latches 5*a*–5*d* by the output signals 14*a* and 14*b* of the control signal generator 11*b* as they are, or $+1$ or $-1$ values 15*a*–15*d* to the variable frequency divider 2.

Next the operation of the $+1/-1$ circuit 11*a* will be described with reference to specific embodiments.

(1) In case the signals 13*a*=13*b*=0, or 13*a*=13*b*=1:

The output control signal 14*b* from the EX-OR 11*c* is 0, all outputs from AND gates (referred to as ANDs hereafter) 11*g*–11*i* are 0, whereby all the corresponding one inputs of EX-ORs 11*j*–11*m* are 0. Consequently, (15*a*, 15*b*, 15*c*, 15*d*)=(12*a*, 12*b*, 12*c*, 12*d*) for any value of the signals 12*a*–12*d*.

(2) In case the signals 13*a*=0, 13*b*=1:

From FIG. 6, it can be seen that the control signals 14*a*=0 and 14*b*=1. When (12*a*, 12*b*, 12*c*, 12*d*)=(0,1,1,1), for example, the output signal 15*d* from the EX-OR 11*m*=0 by 12*d*=1 and 14*b*=1, the output signal from the EX-OR 11*f*=1 by 12*d*=1 and 14*a*=0, the output signal from the AND 11*i*=1 by 14*b*=1, whereby the output signal 15*c* of the EX-OR 11*l*=0 by 12*c*=1. Similarly, the signal 15*b*=0. The output signal 15*a* of the EX-OR 11*j*=1 by 12*a*=0 and the output signal from AND 11*g*=1. Namely, in this case (15*a*, 15*b*, 15*c*, 15*d*)=(1,0,0,0). Similarly the outputs 15*a*–15*d* in this case for all the combinations of inputs 12a–12d is shown in FIG. 7. As shown in FIG. 7, (15a, 15b, 15c, 15d)=(12a, 12b, 12c, 12d)+1.

(3) In case the signals 13a=1, 13b=0:

From FIG. 6, it can be seen that the control signals 14a=1 and 14b=1. In case (12a, 12b, 12c, 12d)=(1,0,0,0), for example, the output signal 15d of the EX-OR 11m=1 by 12d=0 and 14b=1. The output signal of EX-OR 11f=1 by 12d=0, 14a=1, the output signal of AND 11i=1 by 14b=1, whereby the output signal 15c of the EX-OR 11l=1 by 12c=0. Similarly, the signal 15b=1. The output signal 15a of the EX-OR 11j=0 by 12a=1 and the output signal of the AND 11g=1. Namely, in this case (15a, 15b, 15c, 15d)=(0,1,1,1). Likewise the outputs 15a–15d in this case for all the combinations of inputs 12a–12d are shown in FIG. 8. As shown in FIG. 8, (15a, 15b, 15c, 15d)=(12a, 12b, 12c, 12d)−1.

Thus, the signal values 12a–12d set by the switches 3a–3d in FIG. 4 become the signals 15a–15d which are set by selectively turning (1) off both the terminals 8a and 8b . . . maintain mode (2) on the terminal 8a . . . +1 mode (3) on the terminal 8b . . . −1 mode by the switch 8, and the signals 15a–15d are fed to the variable frequency divider 2. Accordingly, if the relationship between the inputs to the variable frequency divider 2 and the rates is as shown in FIG. 3, any pre-set rates can be regulated again in advance, or in retard, by one rate by turning on the switch 8 to the terminal 8a side or the terminal 8b side.

Figure 9:
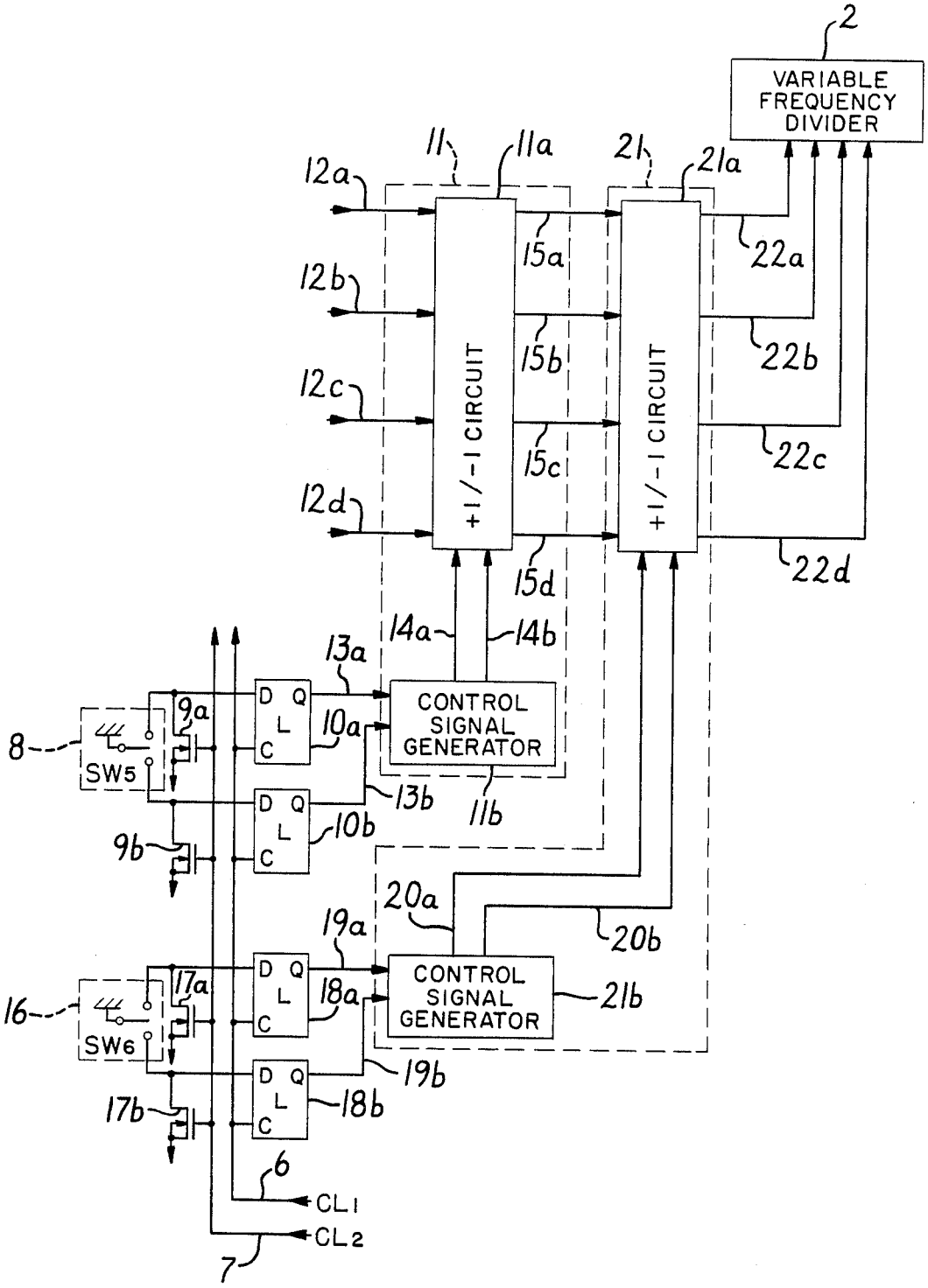

FIG. 9 is a circuitry block diagram showing an embodiment of the present invention comprising two calculation circuits. In FIG. 9 a switch 16, a control signal generator 21b and a +1/−1 circuit 21a are respectively constructed equivalently to the switch 8, the control signal generator 11b and the +1/−1 circuit 11a of the FIG. 4 embodiment. Accordingly the relationship between inputs 19a, 19b and outputs 20a and 20b of the control signal generator 21b is equivalent to that of 13a, 13b and 14a, 14b shown in FIG. 6. The relationship between inputs 15a–15a and outputs 22a–22d of the +1/−1 circuit 21a is equivalent to that of the signals 12a–12d and 15a–15d shown in FIGS. 7 and 8. Accordingly the signals 15a–15d, which maintain, advance, or retard by 1 rate the signal values 12a–12d by the switch 8, are further maintained, advanced, or retarded by 1 rate by the switch 16 to become the signals 22a–22d which are fed to the variable frequency divider 2. By such a construction, 2-steps regulation is enabled in this embodiment, and the maximum regulation range is +2 rates.

As illustrated, the present invention enables re-regulation in an advance mode and in a retard mode by the second switch group against any rates which were set by the first switch group. The first switch group is constructed by cutting off or not cutting off the wiring on the circuit board and the second switch group consists of mechanical traveling contacts, whereby the rates are set by the first switch group by cutting off the wiring on the circuit board under the condition that the second switch group is OFF, while re-regulation is easily made by the second switch group. Since the mechanical traveling contacts are reduced in number and the construction is simplified, the present invention is advantageous for an electronic watch which is restricted in size and construction. Further, new circuitry can be easily designed only by addition of a few circuits to the circuitry of the present invention without using complicated timing signals. This means the present invention is widely adaptable to circuit design. Further, the dispersion of frequency rates in the assembly process is absorbed by re-regulation, because the first re-regulation can be made in the assembly process and the second re-regulation can be made for service after sale.

As a result, the 2-steps re-regulation of rates according to the present invention guarantees a watch with higher accuracy.

What I claim is:

1. In an electronic timepiece having an oscillator for generating a time base signal and a variable frequency divider for dividing the frequency of the time base signal to produce a unit time signal: a logical regulation circuit comprising a first switch group comprised of plural switch members having ON and OFF states; first memory circuits for memorizing the ON-OFF information of the first switch group; a second switch group comprised of at least one switch member having ON and OFF states; second memory circuits for memorizing the ON-OFF information of the second switch group; and a calculation circuit connected to receive the contents of the first and second memory circuits for producing output signals representative of different frequency dividing ratios and for applying the output signals to the variable frequency divider to regulate the frequency dividing ratio thereof.

2. A logical regulation circuit for an electronic timepiece as claimed in claim 1; wherein the calculation circuit is connected to receive only the memory information content of the first and second memory circuits.

3. A logical regulation circuit for an electronic timepiece as claimed in claim 1; wherein the calculation circuit includes means for performing +1 and −1 calculating functions on the content of the first memory circuit in accordance with the content of the second memory circuit.

4. A logical regulation circuit for an electronic timepiece as claimed in claim 1; further comprising at least one more circuitry of similar construction to the circuitry consisting of the second switch group, the second memory circuits and the calculation circuit; and wherein the memory information of the first memory circuits is applied to the variable frequency divider via each calculation circuit.

5. A logical regulation circuit for an electronic timepiece as claimed in claim 1; wherein each of the switch members of the first switch group is constructed by cutting off or not cutting off the wiring on a circuit board and each of the switch members of the second switch group comprises mechanical traveling contacts.

6. In an electronic timepiece having an oscillator for generating a time base signal and a variable frequency divider for dividing the frequency of the time base signal to produce a unit time signal: a logical regulation circuit comprising a first switch group having plural switch members having ON and OFF states; first memory circuits for memorizing the ON-OFF information of the first switch group; a second switch group having at least one switch member having ON and OFF states; second memory circuits for memorizing the ON-OFF information of the second switch group; a control signal generator connected to receive the output of the second memory circuits and for producing a signal dependent on the output of the second memory circuits; and a +1 and −1 arithmetic operating circuit connected to receive the output of the first memory circuits and the signal from the control signal generator for changing the output of first memory circuits by one step and for producing an output signal for setting the frequency dividing ratio of the variable frequency divider.

7. A logical regulation circuit for an electronic timepiece as claimed in claim 6; wherein the control signal generator comprises an exclusive OR gate.

8. In an electronic timepiece having a variable frequency divider: a logic regulation circuit for regulating the frequency dividing ratio of the variable frequency divider comprising first switching means having a plurality of ON and OFF switching states representative of different frequency rates; first memory means for memorizing the ON-OFF information of the first switching means; second switching means having a plurality of ON and OFF switching states representative of different frequency rate adjustment values; second memory means for memorizing the ON-OFF information of the second switching means; and logic circuit means receptive of the information content of the first and second memory means for adjusting the frequency rates represented by the information content of the first memory means in accordance with the frequency rate adjustment values represented by the information content of the second memory means and for producing and applying to the variable frequency divider corresponding frequency rate output signals effective to regulate the frequency dividing ratio of the variable frequency divider.

9. A logic regulation circuit according to claim 8; wherein the logic circuit means comprises a control signal generator connected to the second memory means and operative to produce control signals in dependence on the frequency rate adjustment values represented by the information content of the second memory means, and circuitry connected to the first memory means and the control signal generator and operative to adjust the frequency rates represented by the information content of the first memory means in accordance with the control signals to produce corresponding frequency rate output signals.

10. A logic regulation circuit according to claim 9; wherein the said circuitry comprises means for increasing the frequency rates by one step or decreasing the frequency rates by one step in response to the control signals.

11. A logic regulation circuit according to claim 9; wherein the control signal generator comprises an exclusive OR gate.

12. A logic regulation circuit according to claim 9; wherein the first switching means has permanent ON and OFF switching states which cannot be changed once the switching states are selected; and the second switching means has changeable ON and OFF switching states which can be changed.

13. A logic regulation circuit according to claim 12; wherein the first switching means comprises a plurality of wiring on a circuit board and the switching states are determined by cutting off or not cutting off the wiring; and the second switching means comprises movable and stationary switching contacts.

14. A logic regulation circuit according to claim 8; wherein the first switching means has permanent ON and OFF switching states which cannot be changed once the switching states are selected; and the second switching means has changeable ON and OFF switching states which can be changed.

15. A logic regulation circuit according to claim 14; wherein the first switching means comprises a plurality of wiring on a circuit board and the switching states are determined by cutting off or not cutting off the wiring; and the second switching means comprises movable and stationary switching contacts.

* * * * *